US005794759A

United States Patent [19]

Butts

[11] Patent Number: 5,794,759

[45] Date of Patent: Aug. 18, 1998

[54] PROTECTIVE COVER FOR SWITCHES

[75] Inventor: James M. Butts, Sterling, Va.

[73] Assignee: MCI Corporation, Washington, D.C.

[21] Appl. No.: 769,328

[22] Filed: Dec. 19, 1996

[51] Int. Cl.[6] ..... H01H 9/00

[52] U.S. Cl. ..... 200/43.19; 200/43.01

[58] Field of Search ..... 200/43.01, 43.04, 200/43.07, 43.16, 43.17, 43.19, 43.22

[56] References Cited

U.S. PATENT DOCUMENTS

| | | | |
|---|---|---|---|
| 1,445,847 | 2/1923 | Platt | 200/43.07 |
| 4,506,120 | 3/1985 | Fleischman | 200/43.19 |
| 5,385,417 | 1/1995 | Wade et al. | 200/43.18 X |
| 5,486,660 | 1/1996 | Fasano | 200/43.16 |

*Primary Examiner*—Renee S. Luebke

[57] ABSTRACT

A protective cover for use on a device having a switch. The protective cover prevents inadvertent or accidental operation of the switch, while allowing deliberate or intentional operation of the switch with the protective cover in place. The protective cover includes a plate and a pair of access apertures defined by the plate. One of the pair of access apertures is positioned to enable operation of the switch from a first position to a second position, and the other of the pair of access apertures is positioned to enable operation of the switch from the second position to the first position. The area of each access aperture is of suitable size to prevent inadvertent operation of the switch. The plate is attached to the device using attaching means that allows the plate to be attached to the device in only one orientation.

17 Claims, 4 Drawing Sheets

324'
322'

300
4"
1 1/2"
1"
1 1/2"
312
3/8" DIA.
312
311
311
302
324
322
4"
5/8"
2 5/8"

PROTECTIVE COVER FOR SWITCHES

BACKGROUND OF THE INVENTION

1. Field of the Invention

The present invention relates to covers for switches. More particularly, the present invention relates to protective covers for preventing inadvertent operation of switches.

2. Related Art

Virtually every type of appliance, electronic device, computer, or other type of electrically powered device has one or more switches that control its operation. The switches can be used to turn a device "on" and "off," for example, by applying or removing electrical power to the device. Switches can also be used to control the operational state of the device once it is powered. For example, switches can be used to control the speed of a fan or the temperature of a heater.

Many different types of switches are used to control operation of electrically powered devices. For example, an on/off switch can be configured as a toggle switch having a projecting lever that is pushed through a small arc to operate it between the on and off positions. An on/off switch can also be configured as a push-button switch that is depressed so that the switch latches between the on and off positions. Electronic devices such as calculators, electronic organizers, schedulers, and the like typically use keys having membrane or contact switches that are depressed, such as an "on" key and an "off" key.

One type of switch frequently used as an on/off switch is a rocker switch. A rocker switch is a two position switch designed to see-saw back and forth about a pivot point. In each position, one end of the rocker switch protrudes outwardly, and one end of the rocker switch is non-protruding or flush. To change the position of the rocker switch, pressure is applied to the protruding end to push it inward. This causes the rocker switch to pivot so that the protruding end becomes flush, and the flush end becomes protruding. Only slight pressure is typically required to pivot or operate a rocker switch between the two positions. The amount of pressure required to operate a rocker switch is less than that required to operate, for example, a typical toggle switch. Thus, a rocker switch is more prone to inadvertent or accidental operation than a toggle switch.

The inadvertent or accidental operation of an on/off switch can have consequences ranging from trivial to potentially life-threatening. For example, inadvertently turning on a radio will often have trivial consequences. Inadvertently turning off a computer can have more serious consequences, such as loss of data. The inadvertent or accidental operation of on/off switches on power supply equipment can have very serious or life-threatening consequences. For example, accidentally turning on a power supply can cause injury to individuals working on equipment powered by the power supply. Accidentally turning off a power supply can cause power outages that create unexpected outages on critical equipment, such as communication links, navigation systems, and computer control equipment.

When a switch is inadvertently or accidentally operated, it is often necessary to return the switch to the previous position. For example, if an on/off switch is accidentally turned off, it frequently is necessary to turn it back on. The time required to return the switch to its previous position can be a critical factor in minimizing any danger or adverse consequences resulting from inadvertent operation of the switch. For example, when a power supply has been accidentally turned on or off, it is essential that the power supply be returned to its previous state very quickly to minimize consequences such as power outages, equipment damage, and personnel injury.

Protective covers placed over a switch can be used to prevent inadvertent or accidental operation of a switch. Conventional protective covers not only prevent accidental operation of the switch, but preclude intentional or deliberate operation of the switch as well. A conventional protective cover must be removed or otherwise lifted away from the switch to provide access so that the position of the switch can be changed. The additional time required to remove a protective cover before the switch can be operated can result in longer power outages, and increase the possibility of equipment damage or personnel injury. Additionally, conventional protective covers often preclude a user from visibly seeing the switch, and/or its current position. This makes equipment operation and troubleshooting more difficult, and can increase the time needed by a user to change the switch position. This increased time can lead to equipment damage, personnel injury or other serious consequences when the position of the switch has to be ascertained and/ or changed quickly in an emergency situation.

Thus, there is a need in the art for a protective cover that prevents inadvertent or accidental operation of a switch, while allowing deliberate or intentional operation of the switch with the protective cover in place. There is a further need for such a protective cover that also allows a user to visibly see the switch and its current position. There is a particular need for such a protective cover for switches that are particularly prone to accidental operation, such as rocker switches.

SUMMARY OF THE INVENTION

In one aspect of the present invention, a protective cover for use on a device having a switch is provided. The protective cover of the present invention prevents inadvertent or accidental operation of the switch, while allowing deliberate or intentional operation of the switch with the protective cover in place. The protective cover includes a plate and a pair of access apertures defined by the plate. One of the pair of access apertures is positioned to enable operation of the switch from a first position to a second position, and the other of the pair of access apertures is positioned to enable operation of the switch from the second position to the first position. The area of each access aperture is of suitable size to prevent inadvertent operation of the switch. The plate is attached to the device using attaching means that allows the plate to be attached to the device in only one orientation.

The protective cover of the present invention is preferably made from a visibly transparent material, such as an acrylic plastic, that allows the user to see the switch and its current position. The protective cover is preferably attached to the device using hook and loop fasteners.

In another aspect of the present invention, a protective cover for use on a device having a rocker switch is provided. The protective cover includes a plate and a pair of access holes defined by the plate. One of the pair of access holes is positioned to enable operation of the rocker switch from an on position to an off position, and the other of the pair of access holes is positioned to enable operation of the rocker switch from the off position to the on position. The area of each access hole is of suitable size to prevent inadvertent operation of the switch. The plate is attached to the device using hook and loop fasteners in a manner that allows the plate to be attached to the device in only one orientation.

Features and Advantages

It is a feature of the present invention that it prevents inadvertent operation of a switch while allowing the switch to be deliberately operated by a user with the protective cover in place.

It is a further feature of the present invention that it can be installed in only one orientation, thereby preventing upside-down or backwards installation.

It is yet a further feature of the present invention that it allows a user to visibly see the switch and its current position.

It is yet a further feature of the present invention that it can be installed on a device using non-magnetic means, thereby preventing interference with circuitry, electronic components, magnetic storage media, and the like.

It is an advantage of the present invention that it provides a simple and inexpensive device for protecting against inadvertent or accidental operation of switches.

It is a further advantage of the present invention that it can be used on a variety of devices having a surface-mounted switch to be protected from inadvertent operation. The present invention is further advantageous in that it can be adapted for use with many kinds of switches, including, but not limited to, rocker switches, toggle switches, sliding switches, push-button switches, and membrane or contact switches.

It is yet a further advantage of the present invention that it can be readily attached to non-magnetic materials, such as plastic or aluminum.

BRIEF DESCRIPTION OF THE FIGURES

The present invention is described with reference to the accompanying drawings. In the drawings, like reference numbers indicate identical or functionally similar elements. Additionally, the left-most digit of a reference number identifies the drawing in which the reference number first appears.

DETAILED DESCRIPTION OF THE PREFERRED EMBODIMENTS

The present invention is directed to a protective cover for preventing inadvertent or accidental operation of a switch. In contrast to conventional protective covers, the present invention allows for the deliberate or intentional operation of the switch while the protective cover is installed. This feature minimizes the time that is required to return the switch to its previous position, i.e., the position before it was inadvertently operated. Such time savings can be critical to minimizing power outages, equipment damage, and personnel injury.

The present invention will be described herein as a protective cover for power switches on a power supply. It is to be understood that this description is exemplary in nature, and that the present invention can readily be used on devices other than power supplies.

Figure 1A:
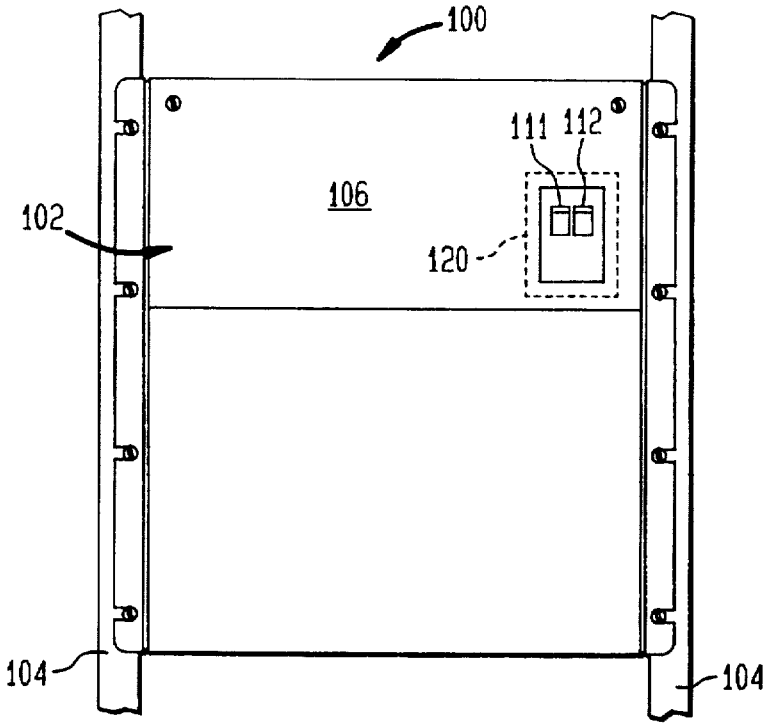
FIGS. 1A and 1B show a power shelf cabinet environment in which a protective cover of the present invention could be installed.
Figure 1B:
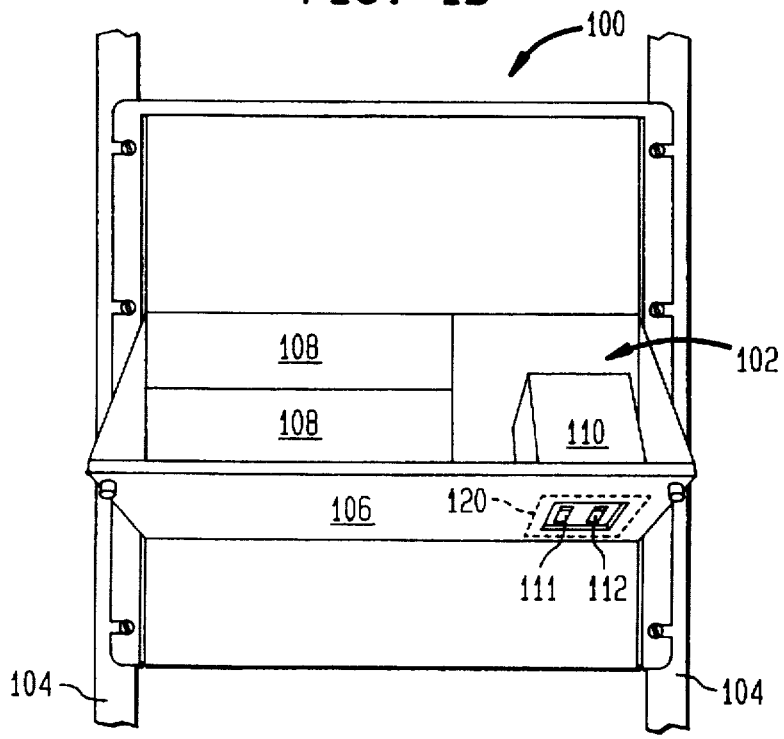

Turning now to FIGS. 1A and 1B, a power shelf cabinet 100 mounted in a shelf frame 104 is shown. Power shelf cabinet 100 could be, for example, a Newbridge Networks Inc., Herndon, Virginia, Main Street family of products, such as the Newbridge 90-0435 Series Power Shelf. Power shelf cabinet 100 includes a power tray 102 having a face plate 106. Power shelf cabinet 100 includes a power switch bank 110. Power switch bank 110 includes a first on/off switch 111 and a second on/off switch 112. Switches 111 and 112 are both rocker switches. Rocker switches are explained in more detail below with respect to FIGS. 4A through 4D.

As shown in FIG. 1A, face plate 106 of power shelf cabinet 100 is in a vertical or upright position. Power tray 102 is hinged so that it can be rotated or dropped down towards a user or operator as shown in FIG. 1B. After power tray 102 is rotated or dropped down to a nearly horizontal position as shown in FIG. 1B, face plate 106 faces downward, away from the user. Rotating power tray 102 to the horizontal position shown in FIG. 1B opens up power shelf cabinet 100 to provide access for maintenance or repair to power switch bank 110 or a power supply 108.

Once maintenance or repair is complete, power tray 102 is returned to the upright position shown in FIG. 1A by swinging or pivoting it upward until face plate 106 is vertical. However, when a user or operator grasps power tray 102 to pivot it upward, switches 111 and 112 are not visible because they are facing downward, away from the user. Consequently, it is possible to inadvertently operate switches 111 and 112 when returning power tray 102 to its upright position. Although switches 111 ad 112 are not flush mounted, the typical recess of approximately ⅜inch does not prevent inadvertent operation. To solve this problem, a protective cover 120 of the present invention could be installed on face plate 106 to prevent inadvertent operation of switches 111 and 112.

Figure 2B:
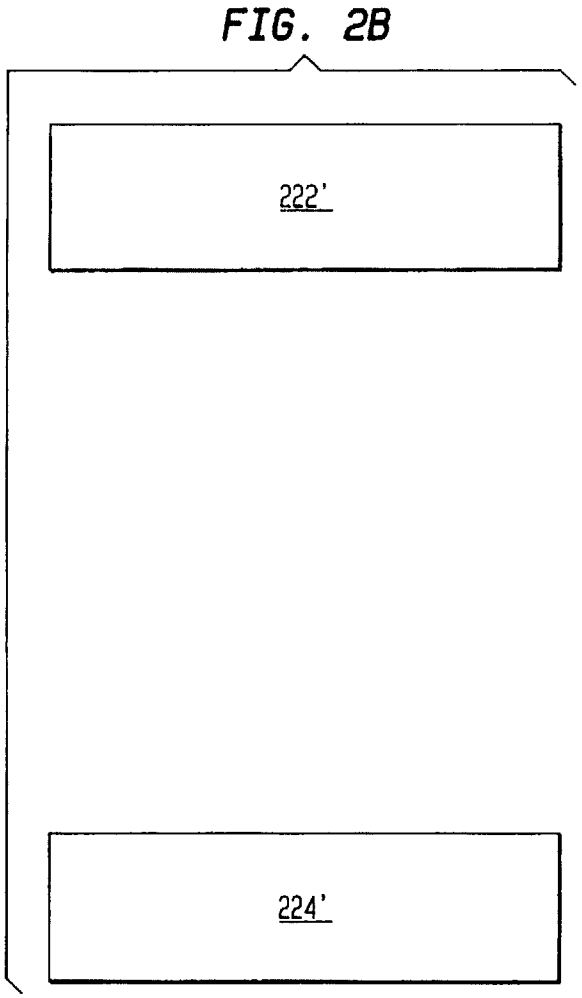
FIG. 2B shows the mating fasteners for attaching the protective cover shown in FIG. 2A to a device.
Figure 2A:
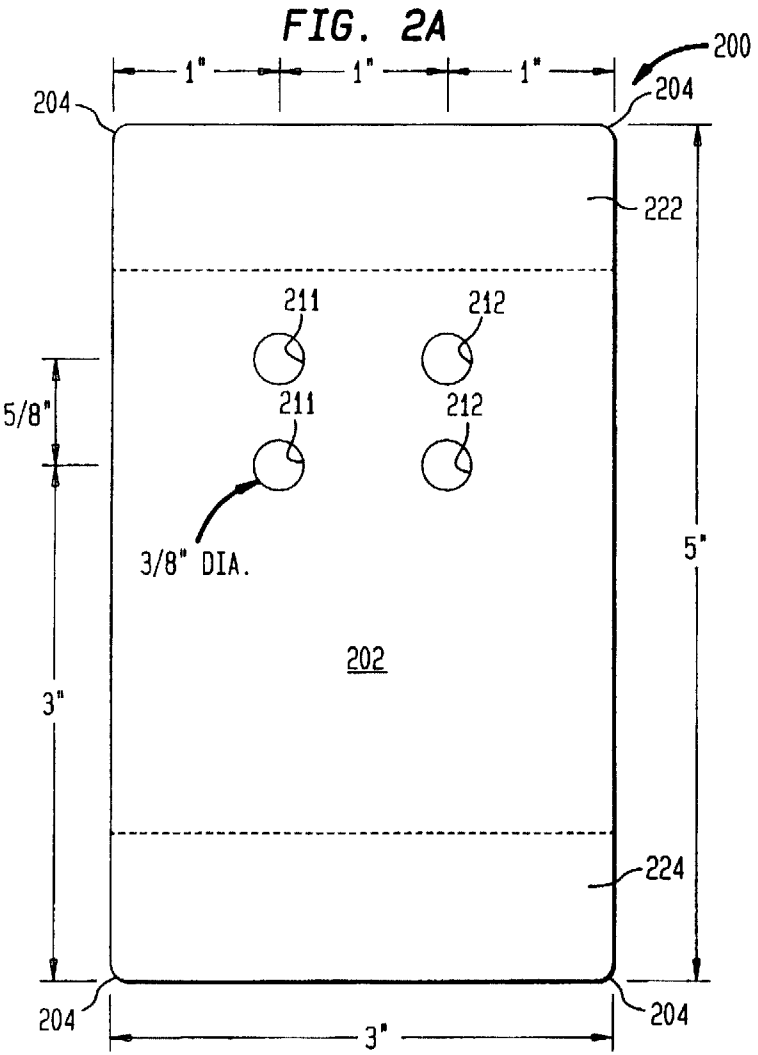
FIG 2A shows a top view of one embodiment of a protective cover of the present invention.

With reference now to FIG. 2A, a top view of one embodiment of a protective cover 200 is shown. The dimensions shown in FIG. 2A are dimensions suitable for use with the two on/off switches on the front panel of a Newbridge 90-0435 Series Power Shelf. The dimensions are provided for illustrative purposes only, and it is to be understood that the present invention is not limited to the dimensions shown.

Protective cover 200 includes a plate 202. Plate 202 is preferably made from a "see-through" material that allows a user to see the switches protected by the cover. Such see-through materials can be clear, transparent, or translucent. Such see-through materials will be referred to herein as visibly transparent. Suitable visibly transparent materials include glass or plastic. A particularly preferred material is a visibly transparent acrylic plastic, such as PLEXIGLASS®. In the embodiment shown in FIG. 2A, plate 202 is made from ⅛" PLEXIGLASS® with comers 204 sanded round.

Plate 202 includes a pair of access apertures 211 to provide access for deliberate or intentional operation of a switch, such as rocker switch 111 shown in FIG. 1. As shown in FIG. 2A, each access aperture 211 is a circular hole.

Although circular access apertures are shown, it is to be understood that access apertures having other shapes can be used. Access apertures 211 can be formed in plate 202 in a manner well known to one of skill in the art. The area of each access aperture 211 is selected to be of suitable size to prevent inadvertent operation of the switch. By "an area of suitable size to prevent inadvertent operation of the switch" is meant an area too small for insertion of a finger of a typical user of the switch, but large enough for insertion of an implement, such as a pencil or screwdriver blade, to operate the switch. It would be readily apparent to one of skill in the art how to select an area of suitable size to prevent inadvertent operation of a particular switch. By way of example, each access aperture 211 shown in FIG. 2A has a diameter substantially equal to ⅜ inch, and an area substantially equal to 0.11 square inches. A typical user of the protected switch (rocker switch 111 in FIG. 1) cannot insert a finger into an aperture of this size, but a pencil or screwdriver blade can be inserted into an aperture of this size to change the position of rocker switch 111.

Figure 4A:
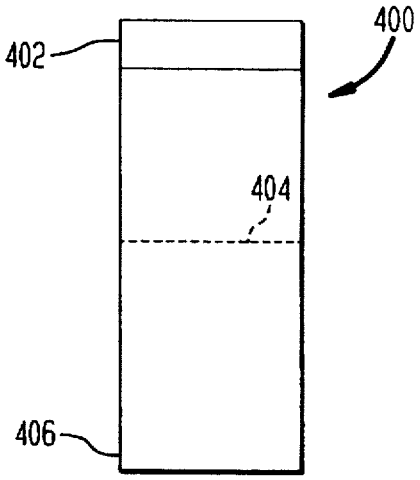
FIG. 4A shows a top view of a rocker switch in a first position.
Figure 4B:
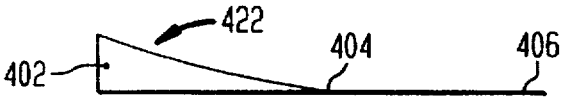
FIG. 4B shows a left side view of the rocker switch shown in FIG. 4A.
Figure 4C:
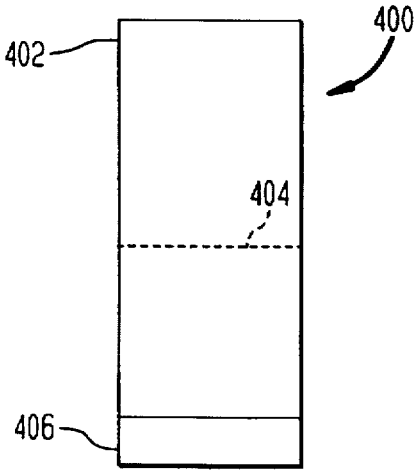
FIG. 4C shows a top view of a rocker switch in a second position.

Access apertures 211 are positioned on plate 202 so that rocker switch 111 can be operated between its two positions. The operation of a rocker switch is shown in more detail in FIGS. 4A through 4D. As shown in FIGS. 4A and 4C, a rocker switch 400 includes a first end 402 and a second end 406. Rocker switch 400 pivots or see-saws back and forth around a central portion 404. In a first position shown in FIG. 4A, end 402 protrudes outwardly, and end 406 is non-protruding or flush. FIG. 4B shows a left side view of rocker switch 400 shown in FIG. 4A, with end 402 protruding outwardly and end 406 flush. To change the position of rocker switch 400 shown in FIGS. 4A and 4B, pressure is applied to push inward on a region of protruding end 402, shown generally at 422. This causes rocker switch 400 to pivot into the second position shown in FIGS. 4C and 4D.

Figure 4D:
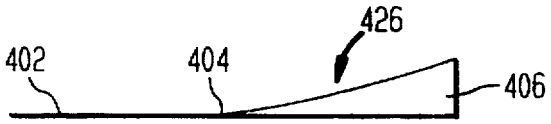
FIG. 4D shows a left side view of the rocker switch shown in FIG. 4C.

In FIGS. 4C and 4D, end 402 is now flush, and end 406 is now protruding. To return rocker switch 400 to the first position shown in FIGS. 4A and 4B, pressure is applied to push inward on a region of protruding end 406, shown generally at 426. This causes rocker switch 400 to pivot into the first position shown in FIGS. 4A and 4B. Only slight pressure is typically required to pivot or operate rocker switch 400 between the two positions. One of the two rocker switch positions shown in FIGS. 4A through 4D corresponds to an "on" position, and the other of the two positions corresponds to an "off" position.

With reference to FIG. 2A, one access aperture 211 is positioned in plate 202 to provide access to region 422, and the other access aperture is positioned in plate 202 to provide access to region 426. A rocker switch, such as rocker switch 111, can be operated between a first position, such as that shown in FIGS. 4A and 4B, and a second position, such as that shown in FIGS. 4C and 4D, without removing protective cover 200. To operate the rocker switch from the first position to the second position, an implement such as a pencil or a screwdriver blade is inserted into one access aperture to apply pressure to region 422, thereby causing the rocker switch to pivot into the second position. To operate the rocker switch from the second position to the first position, an implement such as a pencil or a screwdriver blade is inserted into the other access aperture to apply pressure to region 426, thereby causing the rocker switch to pivot into the first position. In this manner, the rocker switch can be deliberately or intentionally operated by a user with protective cover 200 in place.

Plate 202 shown in FIG. 2A also includes a second pair of access apertures 212. Access apertures 212 provide access for deliberate or intentional operation of a switch, such as rocker switch 112 shown in FIG. 1. All of the foregoing description regarding access apertures 211 applies to access apertures 212, and is omitted for brevity.

Plate 202 is preferably attached to the device having the switch to be protected through the use of "hook and loop tape" or other fabric that can be fastened to itself. A particularly preferred type of hook and loop tape is VELCRO®. One side of the hook and loop fastener is attached to the back surface of plate 202, and the mating side of the hook and loop fastener is attached to the device, such as on face plate 106 shown in FIGS. 1A and 1B.

In a preferred embodiment, the hook and loop tape is configured in such a manner that plate 202 can be installed in only one orientation, thereby preventing upside-down or backwards installation of the protective cover. This is illustrated in FIGS. 2A and 2B. A hook portion 222 of hook and loop tape is affixed to the upper end of the rear surface of plate 202. A loop portion 224 of hook and loop tape is affixed to the lower end of the rear surface of plate 202. In the embodiment shown in FIG. 2A, hook portion 222 and loop portion 224 are horizontally disposed.

Alternatively, the loop side of the hook and loop tape can be affixed to the upper end of plate 202, and the hook side of the hook and loop tape can be affixed to the lower end. The key aspect of installing the protective cover in only one orientation is to ensure that hook and loop portions 222 and 224 have opposite configurations, one being a hook portion and the other being a loop portion.

FIG. 2B shows the mating portions for attaching plate 202 shown in FIG. 2A to a device. A mating loop portion 222' of hook and loop tape is affixed to the device for mating with hook portion 222 affixed to plate 202. A mating hook portion 224' of hook and loop tape is affixed to the device for mating with loop portion 224 affixed to plate 202. In this manner, plate 202 can be affixed to the device in only one orientation, that shown in FIG. 2A. Plate 202 could not be affixed to the device in an upside-down orientation (rotated 180 degrees from that shown in FIG. 2A with hook portion 222 at the lower end and loop portion 224 at the upper end) because hook portion 222 cannot mate in an attaching manner with hook portion 224', and loop portion 224 cannot mate in an attaching manner with loop portion 222'.

Figures 3A, 3B:
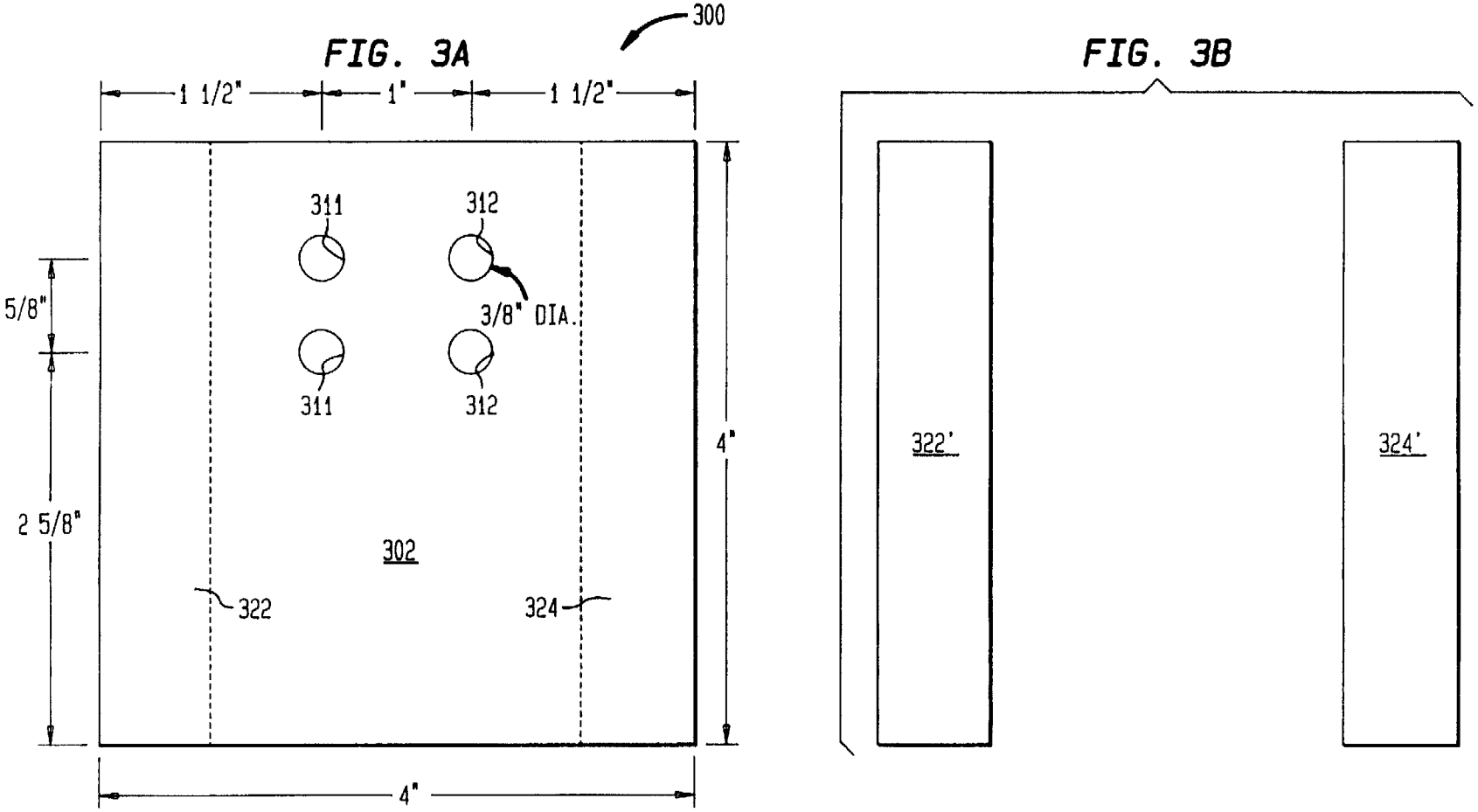
FIG. 3A shows a top view of an alternate embodiment of a protective cover of the present invention.
FIG. 3B shows the mating fasteners for attaching the protective cover shown in FIG. 3A to a device.

An alternate embodiment of a protective cover 300 is shown in FIG. 3A. Protective cover 300 includes a plate 302 and access apertures 311 and 312. Plate 302 and access apertures 311 and 312 are configured in substantially the same manner as described above for FIG. 2A. The dimensions shown in FIG. 3A are provided for illustrative purposes only, and it is to be understood that the present invention is not limited to the dimensions shown.

In the embodiment shown in FIGS. 3A and 3B, plate 302 is affixed to the device using hook and loop portions 322 and 324 that are vertically disposed. Hook and loop portions 322 and 324 mate in an attaching manner with mating hook and loop portions 322' and 324', respectively, in the same manner discussed above for hook and loop portions 222, 222' and 224, 224'. Hook and loop portions 322 and 324 have opposite hook and loop configurations, and for purposes of the following discussion, portion 322 is a hook portion and portion 324 is a loop portion.

Mating loop portion 322' of hook and loop tape is affixed to the device for mating with hook portion 322 affixed to plate 202. Mating hook portion 324' of hook and loop tape is affixed to the device for mating with loop portion 324 affixed to plate 202. In this manner, plate 202 can be affixed to the device in only one orientation, that shown in FIG. 3A. Plate 202 could not be affixed to the 20 device in an upside-down orientation (rotated 180 degrees from that shown in FIG. 3A with hook portion 322 on the right side and loop portion 324 on the left side) because hook portion 322 cannot mate in an attaching manner with hook portion 324', and loop portion 324 cannot mate in an attaching manner with loop portion 322'.

It is to be understood that the hook and loop fasteners can be configured in orientations other than vertical or horizontal. One factor in deciding the orientation is that a user will not be able see through the area of plate 202 over which the hook and loop fastener extends. The orientation and location of the hook and loop fasteners can be selected by one of skill in the art so that any information on the device, such as on face plate 106 shown in FIG. 1, can remain visible to the user. Further, other types of attaching means can be used with the present invention, and configured so that the protective cover can be installed in only one orientation.

The exemplary embodiments of the present invention have been described above as illustrating a protective cover for use with a rocker switch. However, it is to be understood that the present invention is not limited to use with rocker switches, and can be used with other types of switches. The access apertures can be configured to enable operation of switches other than rocker switches, such as toggle switches, slide switches, push-button switches, membrane switches, and the like. Such switches can be operated by inserting an implement through an appropriately positioned access aperture in a manner similar to that described above for rocker switches. It would be readily apparent to one of skill in the relevant arts how to position and size the access apertures for use with such switches. The fastener used to attach the protective cover to the device will result in a space between the protective cover and the device so that the present invention can be used with flush-mounted switches as well as recessed switches.

Conclusion

While various embodiments of the present invention have been described above, it should be understood that they have been presented by way of example only, and not limitation. The protective cover of the present invention may be used with any type of device having switches, and is not limited to use on power supplies. For example, the protective cover of the present invention can be used on a personal computer to protect the on/off switch from inadvertent operation. Likewise, the protective cover of the present invention can be used with other switches, and is not limited to use with rocker switches. Thus, the breadth and scope of the present invention should not be limited by any of the above-described exemplary embodiments, but should be defined only in accordance with the following claims and their equivalents.

What is claimed is:

1. A protective cover for use on a device having a switch, comprising:

a plate;

a pair of access apertures defined by said plate, wherein one of said pair of access apertures is positioned to enable operation of the switch from a first position to a second position, and the other of said pair of access apertures is positioned to enable operation of the switch from the second position to the first position, wherein an area of each of said pair of access apertures is of suitable size to prevent inadvertent operation of the switch; and attaching means for attaching said plate to the device in only one orientation.

2. The protective cover of claim 1, wherein said plate comprises an acrylic plastic material.

3. The protective cover of claim 1, wherein said plate comprises a visibly transparent material.

4. The protective cover of claim 1, wherein each of said pair of access apertures is circular.

5. The protective cover of claim 4, wherein each of said pair of access apertures has a diameter substantially equal to ⅛ inch.

6. The protective cover of claim 1, wherein said attaching means comprises:

a hook portion of hook and loop fastener attached to said plate; and a loop portion of hook and loop fastener attached to said plate, wherein said hook portion mates with a mating loop portion attached to the device, and said loop portion mates with a mating hook portion attached to the device.

7. The protective cover of claim 6, wherein said hook portion and said loop portion are horizontally disposed.

8. The protective cover of claim 6, wherein said hook portion and said loop portion are vertically disposed.

9. The protective cover of claim 1, further comprising:

a second pair of access apertures defined by said plate, wherein one of said second pair of access apertures is positioned to enable operation of a second switch from a first position to a second position, and the other of said second pair of access apertures is positioned to enable operation of the second switch from the second position to the first position, wherein an area of each of said second pair of access apertures is of suitable size to prevent inadvertent operation of the second switch.

10. The protective cover of claim 1, wherein said attaching means is non-magnetic.

11. A protective cover for use on a device having a rocker switch, comprising:

a plate;

a pair of access holes defined by said plate, wherein one of said pair of access holes is positioned to enable operation of the rocker switch from an on position to an off position, and the other of said pair of access holes is positioned to enable operation of the rocker switch from the off position to the on position, wherein an area of each of said pair of access holes is of suitable size to prevent inadvertent operation of the switch;

a hook portion of hook and loop fastener attached to said plate; and a loop portion of hook and loop fastener attached to said plate, wherein said hook portion mates with a mating loop portion attached to the device, and said loop portion mates with a mating hook portion attached to the device, thereby attaching said plate to the device in only one orientation.

12. The protective cover of claim 11, wherein said plate comprises an acrylic plastic material.

13. The protective cover of claim 11, wherein said plate comprises a visibly transparent material.

14. The protective cover of claim 11, wherein each of said pair of access holes has a diameter substantially equal to ⅛ inch.

15. The protective cover of claim 11, wherein said hook portion and said loop portion are horizontally disposed.

16. The protective cover of claim 11, wherein said hook portion and said loop portion are vertically disposed.

17. The protective cover of claim 11, further comprising:

a second pair of access holes defined by said plate, wherein one of said second pair of access holes is positioned to enable operation of a second rocker switch from an on position to an off position, and the other of said second pair of access holes is positioned to enable operation of the second rocker switch from the off position to the on position, wherein an area of each of said second pair of access holes is of suitable size to prevent inadvertent operation of the second rocker switch.

* * * * *